United States Patent [19]

Romanauskas

[11] 4,356,083

[45] Oct. 26, 1982

[54] UNBALANCED ROTOR FOR FIELD FLOW FRACTIONATION CHANNEL

[75] Inventor: William A. Romanauskas, Southbury, Conn.

[73] Assignee: E. I. Du Pont de Nemours and Company, Wilmington, Del.

[21] Appl. No.: 249,962

[22] Filed: Apr. 1, 1981

[51] Int. Cl.[3] ..... B03B 5/62; B04B 9/14

[52] U.S. Cl. ..... 209/155; 233/23 A; 73/468; 74/573 R

[58] Field of Search ..... 233/23 A; 301/5 B, 5 BA; 164/287; 74/573 R; 209/155; 73/460, 461, 468

[56] References Cited

U.S. PATENT DOCUMENTS

| | | | |
|---|---|---|---|
| 3,097,167 | 7/1963 | Beyerle | 233/23 |
| 4,096,988 | 6/1978 | Scuricini | 233/23 A |
| 4,283,276 | 8/1981 | Grant | 209/155 |

OTHER PUBLICATIONS

Den Hartog, "Mechanical Vibrations"—Rotating Machinery, 4th Ed.

National Cancer Institute Monograph 21, "The Development of Zonal Centrifuges and Ancillary Systems for Tissue Fractionation and Analysis", U.S. Department of Health Services. National Cancer Institute, Bethesda, MD.

*Primary Examiner*—Ralph J. Hill

[57] ABSTRACT

The mass center of a field flow fractionation channel is adjusted to coincide with the geometric center of the channel. Under these conditions, above critical rotor speeds, the mass center will coincide with the geometric center of the channel and both will coincide with the spin axis of the rotor. This ensures that all portions of the field flow fractionation channel are subjected to about the same centrifugal force.

4 Claims, 4 Drawing Figures

FIG. 2
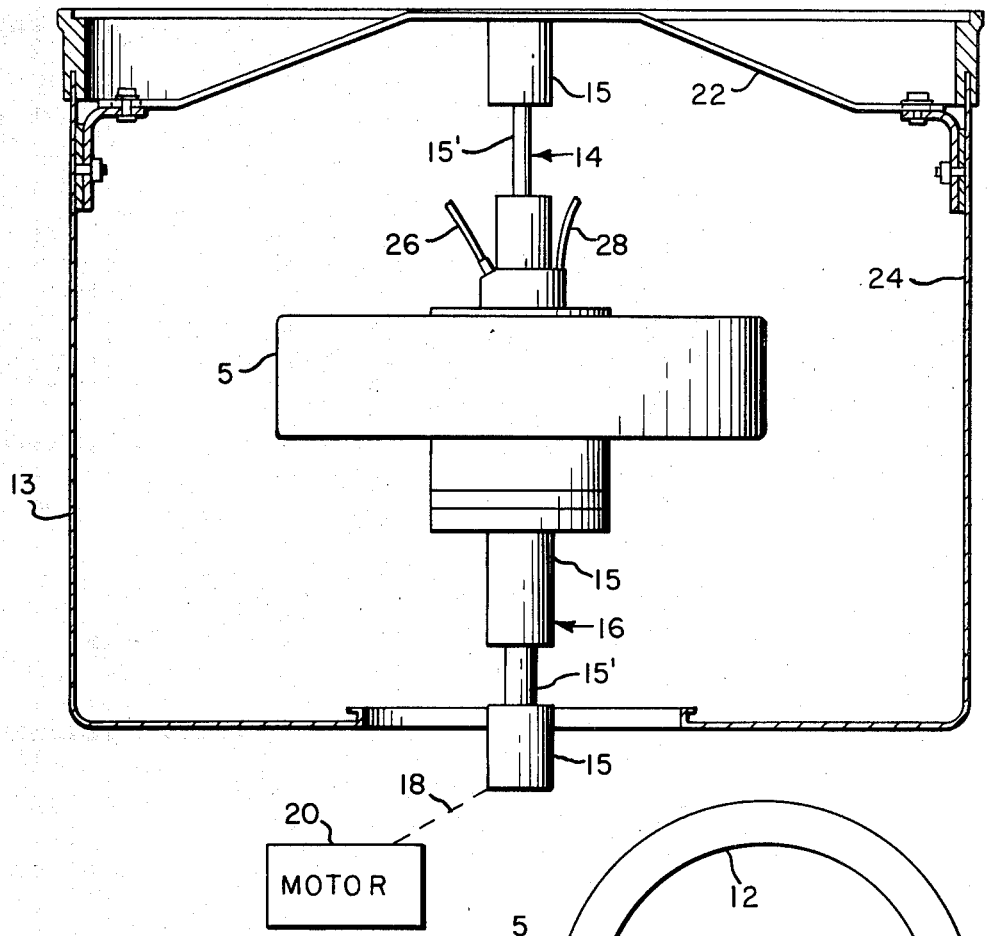
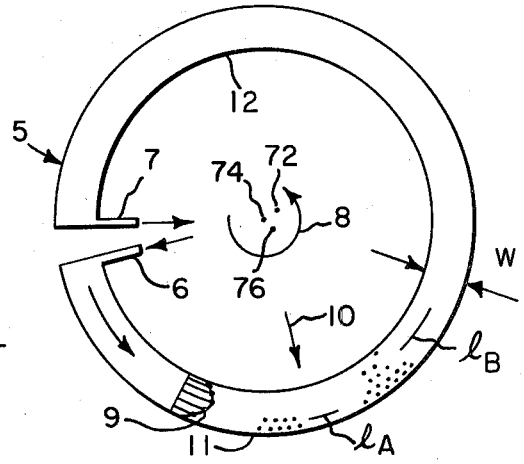
FIG. 1

UNBALANCED ROTOR FOR FIELD FLOW FRACTIONATION CHANNEL

CROSS-REFERENCE TO RELATED APPLICATIONS

This application is related to inventions described in U.S. Pat. No. 4,283,276 issued Aug. 11, 1981 and entitled "Rotor for Sedimentation Field Flow Fractionation" by John Wallace Grant, copending applications Ser. No. 249,961 filed Apr. 1, 1981 and entitled "Rotating Seal for Centrifuges" by W. A. Romanauskas, and Ser. No. 249,963 filed Apr. 1, 1981 and entitled "Field Flow Fractionation Channel" by W. A. Romanauskas.

BACKGROUND OF THE INVENTION

Sedimentation field flow fractionation is a versatile technique for the high resolution separation of a wide variety of particulates suspended in a fluid medium. The particulates include macromolecules in the $10^5$ to the $10^{13}$ molecular weight (0.001 to 1 $\mu$m) range, colloids, particles, micelles, organelles and the like. The technique is more explicitly described in U.S. Pat. No. 3,449,938, issued June 17, 1969 to John C. Giddings and U.S. Pat. No. 3,523,610, issued Aug. 11, 1970 to Edward M. Purcell and Howard C. Berg.

Field flow fractionation is the result of the differential migration rate of sample components in a carrier or mobile phase in a manner similar to that experienced in chromatography. However, in field flow fractionation there is no separate stationary phase as there is in the case of chromatography. Sample retention is caused by the redistribution of sample components between the fast and the slow moving strata within the mobile phase. Thus, particulates elute more slowly than the solvent front.

In the case of a sedimentation force field, which is used in sedimentation field flow fractionation (SFFF), use is made of a centrifuge. A thin annular belt-like channel is made to rotate about the axis of the annulus. The resultant centrifugal force causes sample components of higher density than the mobile phase to sediment toward the outer wall of the channel. For equal particulate density, because of their higher diffusion rate, smaller particulates will accumulate into a thicker layer against the outer wall than will larger particulates. On the average, therefore, larger particulates are forced closer to the outer wall.

If now the mobile phase or solvent is fed continuously from one end of the channel, it carries the sample components through the channel for later detection at the outlet of the channel. Because of the shape of the laminar velocity profile within the channel and the placement of particulates in that profile, solvent flow causes smaller particulates to elute first, followed by a continuous elution of components in the order of ascending particulate mass.

The field flow channels required for low separation times are relatively thin. Because of these thin, ringlike channels, it therefore becomes highly important that the channels be perfectly round and rotate concentrically about the cylinder or geometric axis of the channel. The requirement for concentric rotation is particularly important when a heavy liquid layer is used as described by Romanauskas in his application entitled "Method and Apparatus for Improving Sedimentation Field Flow Fractionation Channels", Ser. No. 249,964, filed Apr. 1, 1981. This concentricity is difficult to achieve since, with the normal manufacturing tolerances that can be realistically achieved in the manufacture of centrifuges, the rotor and its channel are not symmetrical with respect to mass. Because of this, it is customary in the centrifuge field to balance a rotor in much the same manner that an automobile tire is balanced such that the mass center of the rotor coincides with the spin axis of the rotor. Unfortunately, the spin axis does not always coincide with the geometric center of the ringlike flow channel. This causes the channel to rotate accentrically about the spin axis and subject different portions of the flow channel at different times to different centrifugal forces. This is inimical to high resolution separations that normally are sought using field flow fractionation techniques.

SUMMARY OF THE INVENTION

According to this invention, an apparatus is constructed for separating particulates suspended in a fluid medium according to their effective masses. The apparatus typically has an annular cylindrical channel with a cylinder axis and radially inner and outer walls defining the radial thickness of the channel, means including a hub assembly for rotating the channel about a spin axis generally parallel to the cylinder axis, means for passing the fluid medium circumferentially through the channel, and means for introducing the particulates into the medium for passage through the channel. In accordance with this invention, such an apparatus is improved by providing at least a pair of predetermined mass regions located at different points along the cylinder axis and other than at the channel, and a portion of the mass in each of the predetermined regions is adjusted such that the cylinder axis approaches the spin axis above critical speeds of rotation of the channel.

In a preferred embodiment, the predetermined regions are located at the hub assembly. Also, the hub assembly is supported for rotation by a pair of flexible shafts, each located about on the cylinder axis.

A rotor for sedimentation field flow fractionation includes an annular channel with an annulus axis, a hub for mounting the channel for rotation about a spin axis generally parallel to the annulus axis, and means for passing a fluid medium circumferentially through the channel, the rotor being unbalanced for rotation about the annulus axis by rotating the rotor above its critical speed and adjusting the weight balance at the hub to unbalance the rotor such that the spin axis approaches the annulus axis. Using the method or the apparatus of this invention in effect one is adjusting the mass center of the rotor assembly such that it coincides with the geometric center of the flow channel. Under these conditions, virtually all portions of the flow channel are subjected to the same centrifugal force permitting high resolution separation of the components of a sample introduced into the flowing medium.

BRIEF DESCRIPTION OF THE DRAWINGS

Further advantages and features of this invention will become apparent from the following description wherein:

FIG. 1 is a simplified schematic representation of a sedimentation field flow fractionation technique;

FIG. 2 is a cross-sectional elevation view of an SFFF rotor constructed in accordance with this invention;

DETAILED DESCRIPTION OF THE PREFFERRED EMBODIMENT

Figure 4:
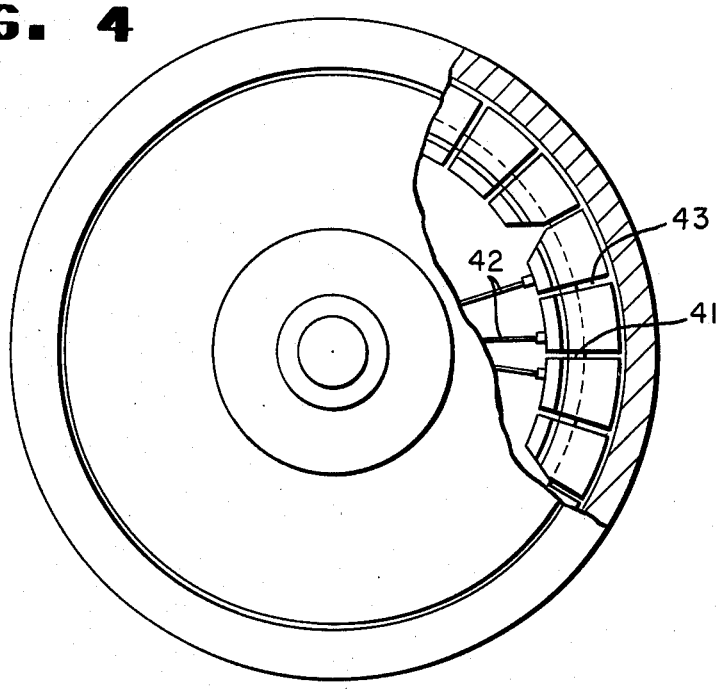
FIG. 4 is a plan view of the field flow fractionation channel of FIG. 3, partially cut away.

The principles of operation of a typical SFFF apparatus with which this invention finds use may perhaps be more easily understood with reference to FIG. 1. With reference to this figure, there may be seen an annular ringlike (even ribbonlike) channel 10 having a relatively small thickness (in the radial dimension) designated W. The channel has an inlet 12 in which the mobile phase or liquid is introduced together with, at some point in time, a small sample containing a particulate to be fractionated, and an outlet 14. The annular channel is spun in either direction. For purposes of illustration the channel is illustrated as being rotated in a counterclockwise direction denoted by the arrow 16. Typically these channels may be in the order of magnitude of 0.025 cm; actually, the smaller the channel thickness, the greater rate at which separations can be achieved and the greater the resolution of the separations.

The channel 10 is defined by an outer surface or wall 22 and an inner surface or wall 23. If now a radial centrifugal force field F, denoted by the arrow 20, is impressed transversely, that is at right angles to the channel, particulates are compressed into a dynamic cloud with an exponential concentration profile, whose average height or distance from the outer wall 22 is determined by the equilibrium between the average force exerted on each particulate by the field F and by the normal opposing diffusion forces due to Brownian motion. Because the particulates are in constant motion at any given moment, any given particulate can be found at any distance from the wall. Over a long period of time compared to the diffusion time, every particulate in the cloud will have been at every different height from the wall many times. However, the average height from the wall of all of the individual particulates of a given mass over that time period will be the same. Thus, the average height of the particulates from the wall will depend on the mass of the particulates, larger particulates having an average height $1_A$ (FIG. 1) and that is less than that of smaller particulates $1_B$ (FIG. 1).

If one now causes the fluid in the channel to flow at a uniform speed, there is established a parabolic profile of flow 18. In this laminar flow situation, the closer a liquid layer is to the wall, the slower it flows. During the interaction of the compressed cloud of particulates with the flowing fluid, the sufficiently large particulates will interact with layers of fluid whose average speed will be less than the maximum for the entire liquid flow in the channel. These particulates then can be said to be retained or retarded by the field or to show a delayed elution in the field. This mechanism is described by Berg and Purcell in their article entitled "A Method For Separating According to Mass a Mixture of Macromolecules or Small Particles Suspended in a Fluid", I-Theory, by Howard C. Berg and Edward M. Purcell, Proceedings of the National Academy of Sciences, Vol. 58, No. 3, pages 862–869, September 1967.

As noted above, when the flow channel of FIG. 1 is part of a centrifuge rotor and rotated in order to effect SFFF separations, the channel has three possible rotational axes. The first is the rotor spin axis 72 which is determined primarily by the bearings which support the rotor for rotation. The second is the geometric center of 74 of the flow channel. Due to manufacturing tolerances this geometric center 74 seldom if ever precisely coincides with the spin axis 72. Finally, there is the mass center 76 of the rotor which, due to manufacturing tolerances, does not coincide with either the spin axis 72 or the geometric center 74 of the channel. It is known of course in the prior art to balance the rotor using conventional balancing machines and other known techniques such that the mass center is adjusted to coincide with the spin axis of the rotor. As noted above, the spin axis of the rotor seldom if ever coincides with the geometric center 74 resulting in different centrifugal force fields being applied to different portions of the channel.

In accordance with this invention the rotor is unbalanced in mass to adjust the mass center of the rotor to coincide with the geometric center of the flow channel. Under these conditions, above critical speeds of operation, the mass center will coincide with the geometric center of the channel and also with the spin axis 72.

This is accomplished in accordance with the method of this invention by adjusting the mass of the hub of the rotor to reduce the run out of the rotor. To accomplish this the rotor is placed into operation and rotated until it exceeds the critical speed of the system. Position sensors may be placed about the circumference of the rotor to sense radial and angular displacements of the rotor. By using a strobe light and otherwise conventional techniques, the location of required weights in the rotor hub 70 both above and below the plane of the flow channel is determined. Next, the weight or mass at these locations is reduced or increased as necessary to reduce the displacements of the rotor so that the flow channel rotates concentrically about the spin axis of the rotor. Under these conditions, of course, it is essential to mount the rotor using a flexible shaft which can bend as the rotor mass center moves to the rotor spin axis above the rigid body critical speeds.

Figure 3:
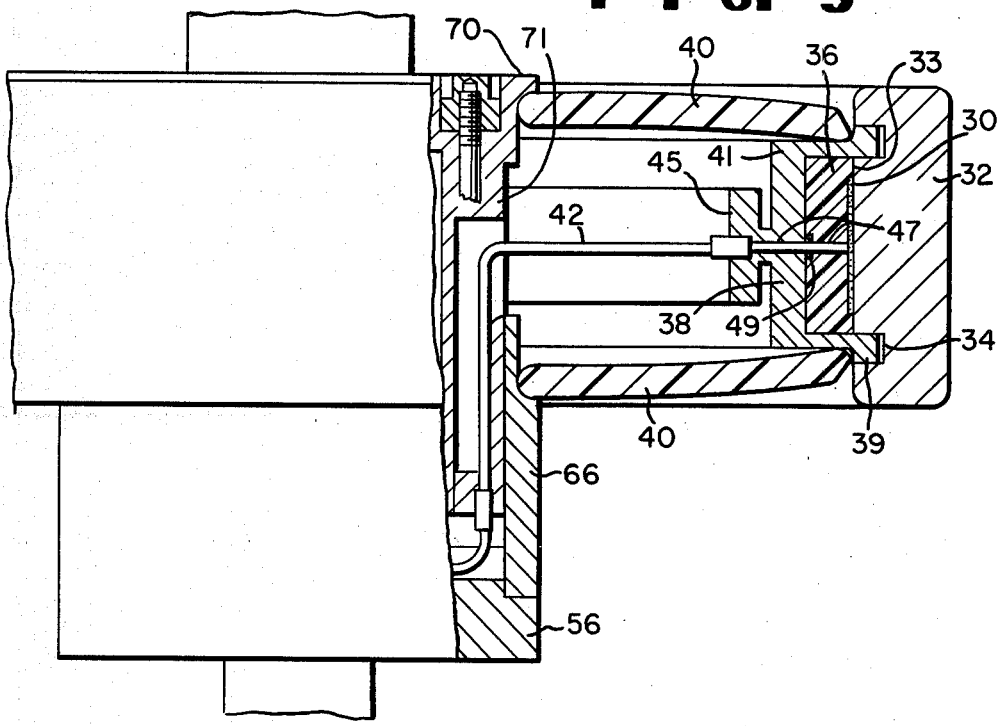
FIG. 3 is a fragmentary elevation view, partially cut away, showing the details of a field flow fractionation channel with which this invention finds use.

By way of complete disclosure, there is depicted with reference to FIGS. 2, 3, and 4 a typical flow channel, such as the type described by Romanauskas in his application entitled "Field Flow Fractionation Channel", unbalanced in accordance with this invention to adjust the mass center of the rotor assembly to coincide with the geometric center of the flow channel.

In FIG. 2 there is seen a centrifuge including a housing or chamber 13 for housing an SFFF type rotor 5 supported by upper and lower flexible couplings 14 and 16, respectively. The preferred flexible shaft couplings may be Heli-cal TM rotating shaft flexible couplings sold by Helical Products Company, Inc. Each coupling consists of a pair of flexible helical elements 15 connected by a rigid shaft 15'. Each element 15 is one in which the helical flexible configuration is a curved beam. The curved beam is made by developing a helical groove around the outside diameter of a cylinder leaving a web which resembles a knife blade wrapped edgewise around an axial wire. This form of coupling permits maximum torsional rigidity and torque capacity. Although the Heli-cal TM flexible coupling is preferred, other known flexible shaft couplings may be used as desired. In fact, any flexible coupling may be used.

The lower flexible coupling 16 is coupled through a suitable linkage, which may be gears or a belt drive, depicted by the dashed line 18, to a suitable prime mover such as a motor 20. The upper flexible coupling 14 is nonrotating and is secured by a mechanical support 22 to the sides 24 of the chamber 13 by any suitable means. Conduits 26 for transmitting fluids to the rotor are coupled to the hub of the rotor which includes a rotating seal (not shown in FIG. 3). A separate conduit 28 is connected to a source of cooling water for cooling the bearings and hence reducing heating of the rotating seal. Such heating is undesirable particularly when using biological materials. In each instance the conduits 26 and 28 are shown singularly for clarity of illustration. In actual practice two conduits 28 are required to provide water to and from the system and two or three conduits 26 are used for the rotor, depending upon the paticular system used. In SFFF, typically three conduits typically are used.

Although any type of rotating seal may be used to couple fluids to and from the flow channel 30, the rotating seal described in the Romanauskas application entitled "Rotating Seal for Centrifuges" is preferred. Alternatively, the rotating seal described in an application Ser. No. 125,854, filed Feb. 29, 1980, entitled "Drive for Rotating Seal", by Charles Heritage Dilks, Jr., may be used. Whatever the rotating seal used, the conduits 42 transmit the fluids from the rotating seal in the rotor hub 70 to the annular channel 30 (FIG. 4). As has been described, rotors for SFFF have an annular ring-like (alternatively, belt-like or ribbon-like) flow channel 30 having a relatively small thickness (the radial dimension).

The channel 30 is defined by a groove formed in the outer peripheral surface of a resilient inner ring 36 formed out of a suitable chemically inert, strong, yet resilient material such as polytetrafluoroethylene. Alternatively, materials such as polyethylene, polyurethane, or nylon may be used. The lands 33 remaining on either side of the groove are maintained in contact with the inner surface of an outer support ring 32, to maintain a leak-free channel 30, by loaded ring segments 38. These segments 38 are U-shaped in cross section with the ends of the U engaging circumferential grooves 34 formed in the radially inner surface of the support ring 32, thus forming a load ring. The support ring may be formed of a suitable material having a high tensile strength as is typically used in centrifuges such as titanium, stainless steel or aluminum. In this manner, as the outer or support ring 32 expands under the influence of centrifugal force, the inner or channel ring 36 is forced by the segments 38 to expand a like amount to maintain sealing contact between the rings.

The flow channel 30 is maintained intact when the rotor is at rest, and is mounted for rotation about the axis of the drive system, by a pair of compression washers 40 which are annular in configuration. Each washer is generally convex in cross section and springy so as to force the segments 38 of the load ring radially outward toward the support ring 32, thus maintaining the inner ring 36, which defines the channel 30, in constant compression against the support ring 32. Fluids are conducted to and from the channel 30 as by the conduits (only a single conduit 42 being shown) within the confines of the rotor 12 through the rotating seal.

The load ring segments 38, which together form the load ring, as seen most clearly in FIG. 4, are separate arcuate shaped sectors or elements having the U-shaped cross section with the ends 39 of the U being slidingly positioned in the grooves 34. The bottom of the U, depicted by the reference numeral 41, constitutes the continuous connecting element of each U-shaped segment 38 with the remaining portions of the U cut away as seen at 43 to permit some flexing of the segments 38. In this manner, the segments 38 accommodate the expansion and contraction of the channel ring 36. These flexing slots or cuts 43 are seen most clearly in FIG. 4 and extend through the uprights of the U.

The bottom of the U-shaped sectors 38 are formed to have a T-shaped cross section 45. The particular mass provided by the T-shaped cross section 45 is that required to provide the necessary weight loading for the load ring. This loading, as is more fully described to said Romanauskas application, is necessary to cause bowing along the rotor axis, i.e., the thickness of the flow channel, to correlate with the bowing of the support ring 32.

Each sector 38 as well as the channel ring 36 have bores 47 therein to permit the fluid in the conduit 42 to communicate with the channel 32. A suitable screw coupling couples the conduit 42 to the bores 47. O-ring seals 49 may provide an appropriate seal between the segments 38 and the channel ring 36. The compression washers 40, as previously described, statically load the channel ring and support both the support ring and the channel ring for suitable rotation about the rotor hub 70. The compression washers 40 are mounted on the rotor hub 70 at the top 71 and on a spring loading ring 66 secured to the base 56 of the rotor hub.

There has thus been described a relatively simple SFFF channel and method for unbalancing the channel such that the mass center coincides with the spin axis.

I claim:

1. In an apparatus for separating particulates suspended in a fluid medium according to their effective masses, said apparatus having an annular cylindrical channel with a cylinder axis, and radially inner and outer walls defining the radial thickness of said channel, means including a hub assembly for rotating said channel about a spin axis generally parallel to said cylinder axis, means for passing said fluid medium circumferentially through said channel, and means for introducing said particulates into said medium for passage through said channel, the improvement wherein said apparatus has at least a pair of predetermined mass regions located at different points along said cylinder axis and other than at said channel, a portion of the mass in each of said predetermined regions being adjusted so that said cylinder axis approaches said spin axis above critical speeds of rotation of said channel.

2. The apparatus of claim 1 wherein said predetermined regions are located at said hub assembly.

3. The apparatus of claim 1 or 2 wherein said hub assembly is supported for rotation by a pair of flexible shafts each located about on said cylinder axis.

4. A rotor for sedimentation field flow fractionation having an annular channel with an annulus axis, a hub for mounting said channel for rotation about a spin axis generally parallel to said annulus axis, and means for passing a fluid medium circumferentially through said channel, said rotor being adjusted in balance for rotation about said annulus axis by:

rotating said rotor above its critical speed, adjusting the weight balance of said hub to unbalance said rotor such that said spin axis approaches said annulus axis.

* * * * *